US005193862A

United States Patent [19]

Oden

[11] Patent Number: 5,193,862

[45] Date of Patent: Mar. 16, 1993

[54] ANTI-THEFT LATCH MECHANISM ESPECIALLY SUITABLE FOR VENDING MACHINES

[75] Inventor: Kenneth W. Oden, Charles Town, W. Va.

[73] Assignee: Royal Vendors, Inc., Kearneysville, W. Va.

[21] Appl. No.: 832,216

[22] Filed: Feb. 6, 1992

[51] Int. Cl.[5] ..... E05C 9/00

[52] U.S. Cl. ..... 292/50; 292/251; 292/125; 292/110

[58] Field of Search ..... 292/50, 28, 110, 125, 292/67, 262, 214, 117, 244, 25, DIG. 14, DIG. 44, DIG. 22, DIG. 65, 251

[56] References Cited

U.S. PATENT DOCUMENTS

| | | | |
|---|---|---|---|
| 197,115 | 11/1877 | Frees . | |
| 1,112,620 | 10/1914 | Johnson | 292/DIG. 15 X |
| 1,596,324 | 8/1926 | Trood . | |
| 1,613,023 | 1/1927 | Diete . | |
| 2,090,638 | 8/1937 | Romine | 292/50 X |
| 2,702,866 | 2/1955 | Anderson | 292/67 X |
| 3,314,703 | 4/1967 | Fitzpatrick | 292/21 |
| 3,678,716 | 7/1972 | Cobb | 292/67 X |
| 4,465,328 | 8/1984 | Tihanyi et al. | 292/67 X |
| 4,993,247 | 2/1991 | Ninemura | 292/251 X |

*Primary Examiner*—Richard E. Moore
*Attorney, Agent, or Firm*—Mason, Fenwick & Lawrence

[57] ABSTRACT

An anti-theft latch mechanism is especially suitable for securing vending machines. According to the present invention, a control mechanism (such as a rotatable stud attached to a knob) includes a clutch arrangement by which the control mechanism remotely controls a latch portion. Thus, the control mechanism is not rigidly tied to the remote latch, thereby avoiding possible damage to the latch and relaxing design criteria for the mechanism as a whole. A latch portion prevents vandals or thieves from pushing the door either inward or outward as they attempt to gain entry to the inside of the vending machine. For this purpose, the latch provides a cove in which a catch in the side of the vending machine is enclosed at least partially on all four sides when the door is closed. This cove arrangement substantially prevents the latch from being shaken loose even when the vandal or thief jars the machine.

17 Claims, 3 Drawing Sheets

ANTI-THEFT LATCH MECHANISM ESPECIALLY SUITABLE FOR VENDING MACHINES

BACKGROUND OF THE INVENTION

1. Field of the Invention

The present invention relates to apparatus and methods of securely latching doors to cabinets. More specifically, the invention relates to anti-theft latch mechanisms for securing vending machines.

2. Related Art

Thievery and vandalism have long been problems for cabinets containing valuable items or money, such as vending machines. In known vending machines, thieves may pry open the bottom of the door to gain access to a change box. Similarly, thieves may pry open the top of the door to gain access to bills in a dollar bill validator.

By using a crow bar or other instrument near the top or bottom of the door, the thieves gain entry by effectively causing the door to rotate about a handle-lock mechanism which is typically located in the middle portion of the door. When the bottom of the door is pried outward, the top of the door may be forced inward; similarly, when the top of the door is pried outward, the bottom of the door may be forced inward.

There are known systems of securing a door. For example, U.S. Pat. No. 3,314,703 (Fitzpatrick) discloses a panic release unit for windows in which a pressure plate causes rods to unlatch remotely located hooks from catches, thereby allowing the window to be quickly opened. U.S. Pat. No. 197,115 (Frees) discloses a lock for barn doors in which a threaded handle is unscrewed, drawing cords which are connected to upper and lower spring-loaded latches to thereby free the latches from staples in the door frame. U.S. Pat. No. 1,596,324 (Trood) employs a similar arrangement, having a lever-like handle which controls the position of a remote latch. Finally, U.S. Pat. No. 1,613,023 (Diete) discloses a door lock in Which a rotatable, key-lockable handle with a shaft is connected to chains which lift toothed latches from respective toothed catches in the top and bottom of the door frame. These patents, and all other documents cited herein, are incorporated herein by reference.

Unfortunately, none of these known systems provide adequate safeguards against theft and vandalism which are experienced in vending machines.

First, even if these systems were somehow adapted to the field of vending machines, they would not adequately prevent the latch from being shaken loose when a vandal or thief jars the machine while pulling outward on the door, thus allowing the latch to come loose from the catch and allowing the door to open.

Second, if these systems were somehow adapted to the field of vending machines, they would allow a vandal or thief to push the bottom (or top) of the door inward, thereby causing the top (or bottom, respectively) to extend outward, allowing the vandal or thief access to the interior of the vending machine.

Third, these systems involve rigid or unyielding connections between the knob or other control mechanism, and the latch. This rigid or unyielding connection can cause damage to the latch in the form of bending or breaking, thereby causing the latch to be ineffective in securing the door. Also, this rigid or unyielding connection requires the design to have much smaller tolerances, such as requiring the handle (for example, the Diete handle) to turn only a given predetermined angle, to prevent stress on the latch.

Therefore, there is a need in the art to provide an anti-theft latch mechanism especially suitable for vending machines which prevents vandals or thieves from pushing the door either inward or outward as they attempt to gain entry to the inside of the vending machine. Further, there is a need to provide a latch mechanism especially suitable for vending machines in which the control mechanism (such as a handle) is not rigidly tied to the remote latch, thereby avoiding possible damage to the latch and relaxing design criteria for the mechanism as a whole.

SUMMARY OF THE INVENTION

The present invention provides an anti-theft latch mechanism especially suitable for vending machines in which the foregoing design objectives are solved.

According to the present invention, a control mechanism (such as a rotatable stud attached to a knob) includes a clutch arrangement by which the control mechanism remotely controls a latch portion. Thus, the control mechanism is not rigidly tied to the remote latch, thereby avoiding possible damage to the latch and relaxing design criteria for the mechanism as a whole.

Further, the invention provides a latch portion which prevents vandals or thieves from pushing the door either inward or outward as they attempt to gain entry to the inside of the vending machine. For this purpose, the preferred latch according to the present invention provides a cove in which a catch in the side of the vending machine is enclosed at least partially on all four sides, when the door is closed. This cove arrangement substantially prevents the latch from being shaken loose even when the vandal or thief jars the machine.

BRIEF DESCRIPTION OF THE DRAWINGS

The invention is better understood by reading the following detailed description of the preferred embodiments with reference to the accompanying drawing figures, in which like reference numerals refer to like elements throughout, and in which.

DETAILED DESCRIPTION OF THE PREFERRED EMBODIMENTS

Figure 1:
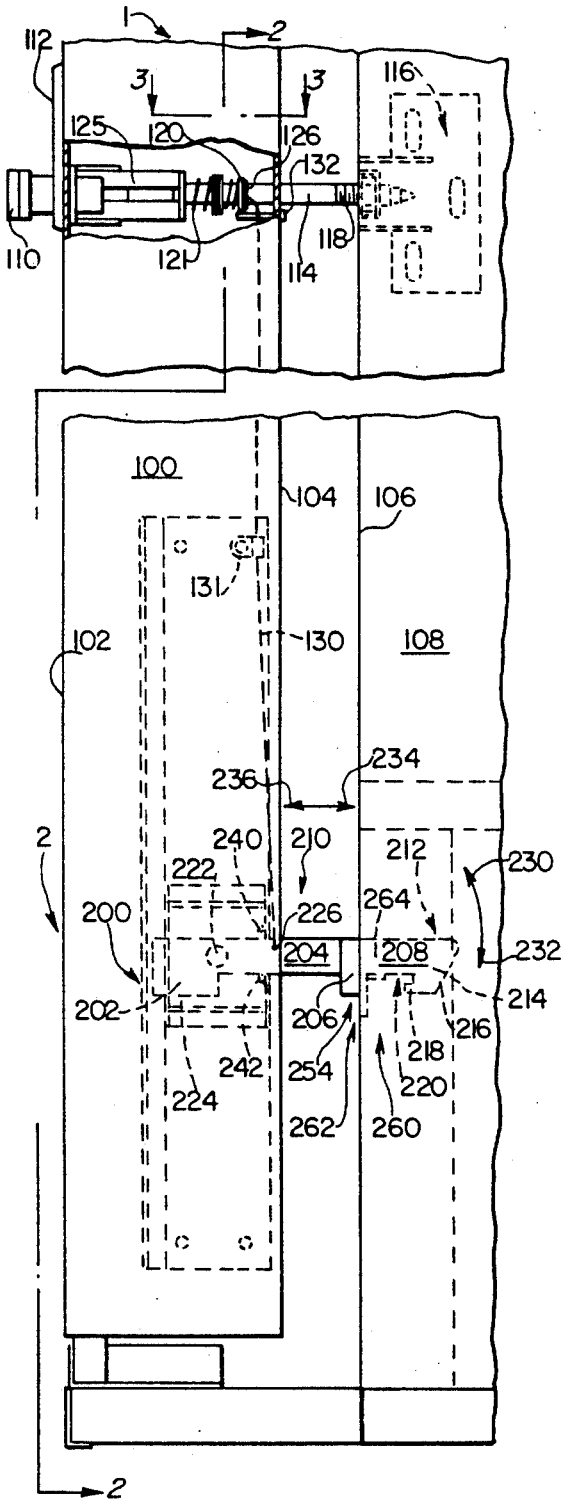
FIG. 1 is a side view, partially cut away, illustrating an upper control portion 1 and a lower latching portion 2 according to a preferred embodiment of the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose. For example, terms such as "clockwise", "counter-clockwise", "up", "down", "left", and "right" are used to facilitate the description of a preferred embodiment, but the scope of the invention should not be limited by these terms.

The present invention is especially useful in preventing theft from cabinets such as vending machines, the thieves prying open the door of the vending machine to gain access to the change box, the bill validator, or contents being sold. Referring collectively to the drawing figures, a preferred embodiment of the anti-theft mechanism of the present invention is used with a door of the vending machine, the door being generally indicated as element 100. Door 100 is provided with an outer face 102 and an inner face 104. Typically, such doors are provided with a periphery which extends inwardly toward the main body of the cabinet, the line where the periphery of the door meets the cabinet being indicated as element 106. The interior of the cabinet or vending machine, which is to be protected from the public and from potential vandals or thieves, is indicated 108.

Figure 2:
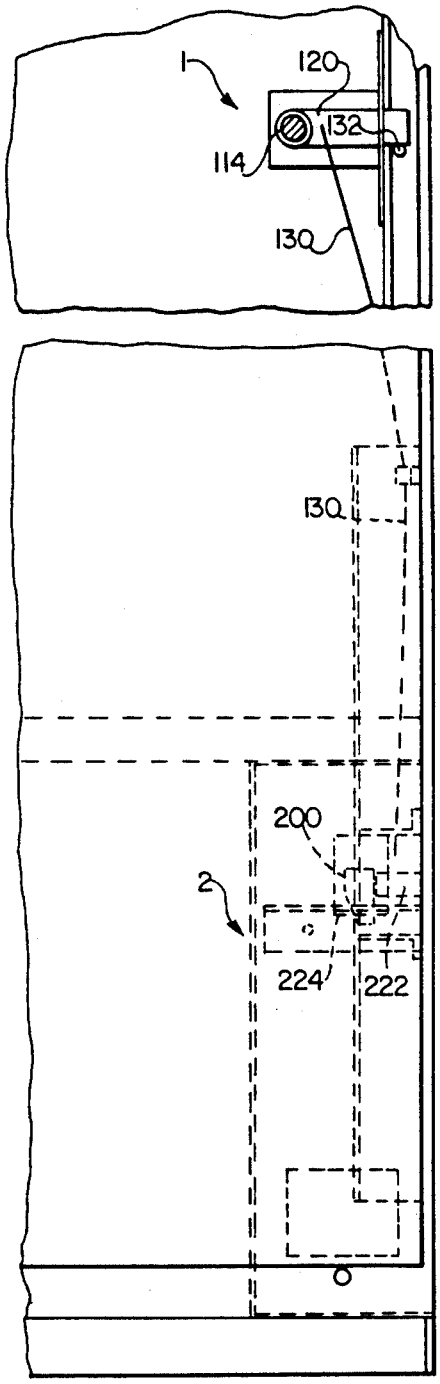
FIG. 2 is a sectional view, 2—2 from FIG. 1, showing the control portion and latching portion in a front view.
Figure 4:
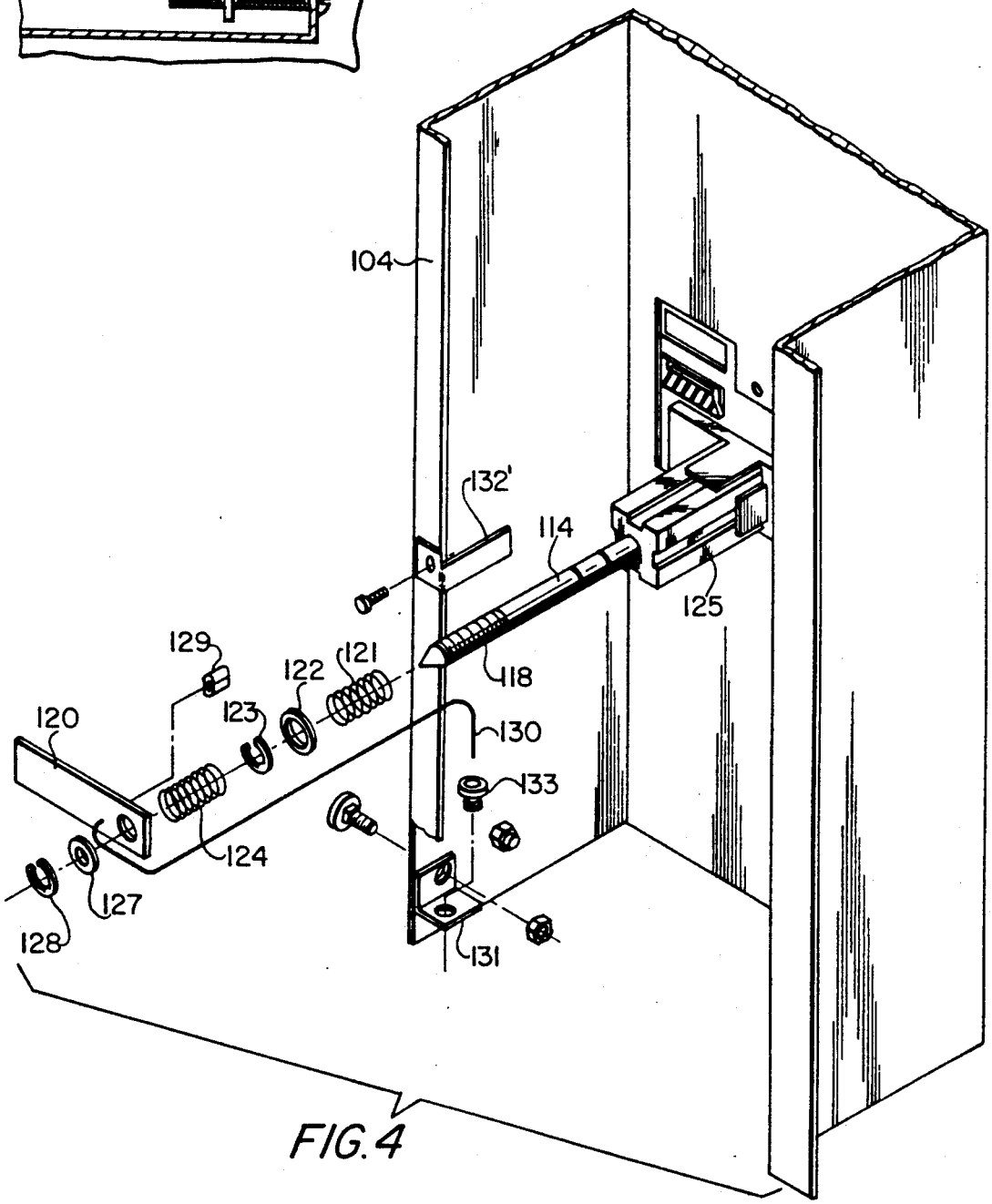
FIG. 4 is an exploded perspective view of a preferred control portion 1.
Figure 6:
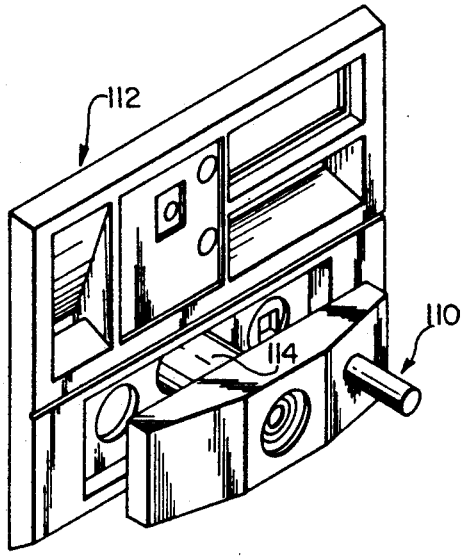
FIG. 6 is a perspective view of a typical knob for the control portion of the embodiment of FIGS. 1–5.

A control portion of the preferred embodiment is preferably provided approximately midway between the top and bottom of the door, as illustrated most clearly in FIGS. 1, 2 and 4. A typical knob which may be used to embody the present invention is shown in FIG. 6. A preferred control portion includes a known screw type "tee" handle knob 110. The "tee" handle screws into and out of a handle body 112. Handle 110 is provided with a handle stud 114 which projects horizontally inwardly into the cabinet or vending machine, terminating in a threaded portion 118. As is appreciated by those skilled in the art, the handle is turned by a key, the handle capable of being turned multiple rotations to allow the door to open and close.

In the interior of the cabinet or vending machine, a receiving portion 116 is provided, preferably affixed to a vertical surface of a side panel of the cabinet or vending machine. In operation, as handle 110 is turned through several rotations, the threaded portion 118 of stud 114 rotates within a counter-threaded aperture within the receiving portion 116, allowing the door 100 to be opened or closed, depending on the direction of rotation. Conventionally, rotating the handle clockwise causes the stud to be screwed further into the receiving portion, securing the door. Rotating the handle counter-clockwise causes the stud to be unscrewed from the receiving portion, freeing the control portion and allowing the door to be opened.

The preferred embodiment of the control portion further includes a generally rectangular bracket 120, which is penetrated by stud 114 near an end of the bracket. Bracket 120 is provided with a hole through which the stud 114 may pass, with bracket 120 oriented perpendicular to the axis of the stud. Bracket 120 is not permanently affixed to the stud, and may freely rotate about it.

An E-ring or other structure 128 is securely affixed to stud 114 at a point further from the handle than the bracket. Alternatively, a radial integral extension of stud 114 may be provided. A stud housing 125 is also provided, between the bracket 120 and the handle body 112, preferably on the inside of the door 100. A first spring 121, washer 122, E-ring 123, and second spring 124 are provided, and extend between the shoulder of stud housing 125 and bracket 120. Nyliner 127 and E-ring 128 are provided outside bracket 120 and disk 126. Spring 121 is provided for shock absorbance, to cushion the door if it is slammed; spring 124 serves the following important function in the invention.

The spring 124 forces bracket 120 away from stud housing 125, pressing the bracket against E-ring 128. The force with which spring 124 press®s bracket 120 against E-ring 128 is chosen so as to cause the bracket to normally rotate with the stud 114, but still allow the stud to continue to rotate without the bracket, when the bracket meets a barrier. In this manner, the arrangement of spring 124 pressing loose bracket 120 against fixed E-ring 128 may be thought of as a clutch mechanism, allowing slippage between the bracket and the E-ring/-stud when necessary.

A bracket stop 132 or 132' is provided at a position where it can stop motion of bracket 120. Preferably, the bracket stop is provided on the inner face 104 of the door. Bracket stop 132 may be simply a #10-32 screw on door portion 104 (see FIG. 3). In an embodiment illustrated most clearly in FIG. 4, a portion 104 of the door serves as a bracket stop support for bracket stop 132, which extends inwardly toward the outer face 102 of the door. Regardless of how the bracket stop 132 or 132' is supported, it is positioned with respect to the expected range of motion of the bracket so as to stop it, in accordance with principles to be described below.

Figure 5:
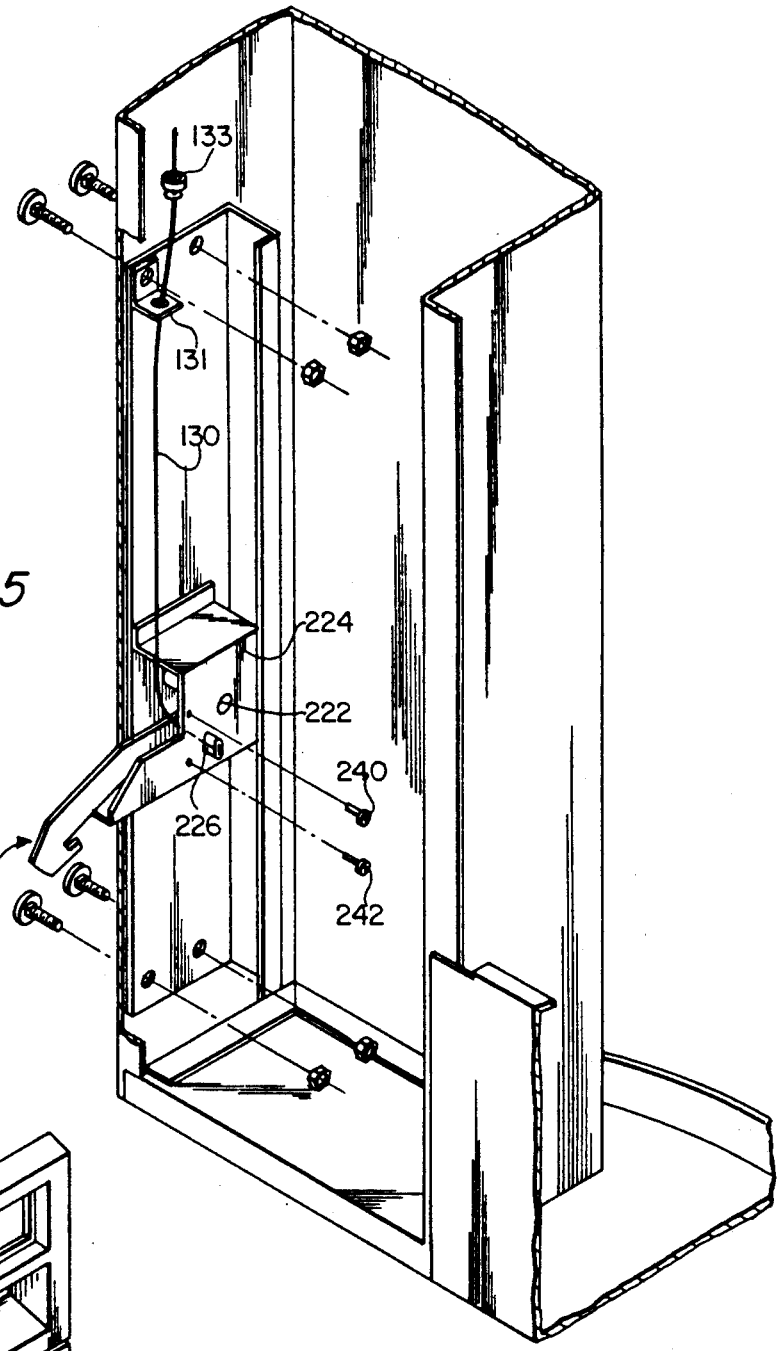
FIG. 5 is an exploded perspective view of a preferred latching portion, 2.

The present invention also provides a latching portion 2, the latching portion preferably provided near a bottom of the door as shown in FIGS. 1, 2 and 5. The latching portion includes a latch 200. Latch 200 includes a latch main body, generally indicated as 210, as well as a latch hook portion, generally indicated as 212.

The illustrated exemplary latch main body is a generally rectangular body, with the longer dimension oriented horizontally. Latch main body 210 includes a wide counterweight area 202, a narrower cable attachment area 204, a broadened shoulder stop area 206, and a narrower portion 208 extending to meet hook portion 212. In the preferred embodiment, latch main body 210 and hook portion 212 are of unitary metallic construction, the present description of different portions of the structure being provided only for purposes of illustration.

Latch hook portion 212 includes an end segment 214 extending generally perpendicular to the generally rectangular latch main body 210 at an end thereof. Latch end segment 214 is provided with an outer strike surface 216 which slopes at an inside angle of less than 90° with respect to the latch main body. At the end of end segment 214 opposite that at which the latch hook portion attaches to the latch main body, a lip 218 is provided. The inner surface of the hook portion 212 forms a cove 220, the cove 220 being defined by narrow portion 208, the inner surface of end segment 214, and the upper surface of lip 218.

A horizontally-oriented cylindrical pivot 222 passes through the latch between portions 202 and 204 to allow the latch to rotate vertically, in directions 230, 232. Pivot 222 is secured to the side of the door 100 by a heavy gauge steel attaching means, generally indicated as element 224. Attaching means 224 may be attached to a panel which is in turn attached to the side of the door by carriage bolts.

Control portion 1 and latching portion 2 are joined and interact in the following manner.

Figure 3:
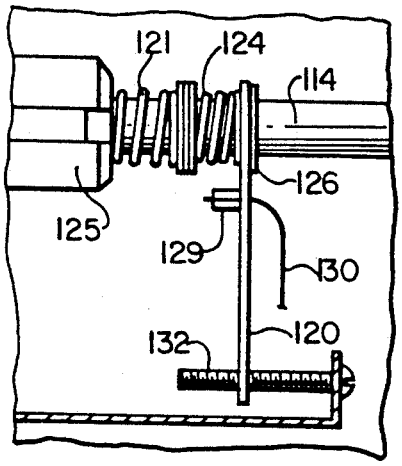
FIG. 3 is a second sectional view, 3—3 from FIG. 1, showing elements of the control portion on a larger scale.

A cable 130 is securely affixed to a cable sleeve 129 on bracket 120, as well as to a cable sleeve 226 on latch main body 210. Cable 130 is preferably a 3/64-inch diameter cable securing affixed to bracket 120 at a point one-quarter of the distance from stud 114 to bracket stop 132 at its point of intersection with the bracket, as shown in FIG. 3. One or more cable guides 131 with respective bushings 133 may be provided, to guide the cable 130 between the control portion 1 and the latching portion 2. The cable guides may be attached to the side of the door by carriage bolts.

As the operator rotates handle 110 in a first direction (for example, counter-clockwise), bracket 120 is lifted. The upward motion of bracket 120, and therefore of cable 130, causes latch 200 to rotate upward, in direction 230. The upward rotation of the latch is limited by an upper limit structure 240 affixed to attaching means 224.

Conversely, when the operator turns handle 110 in the opposite direction (clockwise, in this example), bracket 120, and therefore cable 130, are lowered. The lowering of cable 130 cause latch 200 to rotate downward, in direction 232. The downward rotation of the latch is limited by a lower limit structure 242, affixed to attaching means 224. Preferably, limit structures 240, 242 are #8-32 screws threaded through attaching means 224.

The positioning of limit structures 240, 242 are chosen in accordance with principles described below.

The preferred embodiment further provides a catch 260. Preferably, catch 260 is attached to the side panel of the cabinet or vending machine, near the front edge of the side panel, arranged opposite but slightly below the horizontal center line of the latch 200. Catch 260 is preferably an inverted "L" shaped member, with a vertical cabinet strike surface 262 located in front of a horizontal member 264 which projects rearwardly into the cabinet.

When the operator attempts to close the door, latch 200 is resting atop lower limit structure 242. The location of limit structure 242 is chosen s that it maintains latch 200 high enough so that, as the operator closes the door, slanted latch strike surface 216 contacts cabinet strike surface 262. This contact causes latch 200 to be forced upward slightly, allowing it to pass over catch 260. After hook portion 212 passes completely over catch 260, latch 200 falls back down under the force of gravity, so that narrow portion 208 rests atop catch 260.

Shoulder stop area 206 extends downward from narrow portion 208, forming a shoulder stop surface 254. Shoulder stop surface 254 prevents the bottom of door 100 from moving further into the cabinet (in direction 234) as it meets cabinet strike surface 262. Conversely, as the bottom of door 100 attempts to move outward (in direction 236), catch horizontal member 264 is caught within cove 220, and is secured in the cove. Lip 218 secures catch horizontal member 264 in cove, even in the presence of rattling or jarring of the entire cabinet or vending machine.

In addition to the particular implementation described above, all materials for the present invention are made of metal or other suitable material chosen in accordance with the principles known to those skilled in the art.

The preferred structure of the preferred embodiment of the present invention having been described above, the operation and some of the advantages of the invention are now described.

As described briefly above, the operator's turning of handle 110 (conventionally, counter-clockwise) causes bracket 120 to rotate upward with stud 114, until latch 200 strikes upper limit structure 240. Upper limit structure 240 is positioned so as to allow hook portion 212 to be lifted higher than catch 260. Cable 130, which connects latch 200 to bracket 120, prevents further motion of bracket 120. Thus, after latch 210 contacts limit structure 240, continued turning of handle 110 causes no further rotation of bracket 120. Hook portion 212 is lifted over catch 260, allowing door 100 to be opened (in direction 236).

The clutch action of spring 124 pressing bracket 120 against E-ring 128, retains bracket 120 in its upper position. Retaining bracket 120 in its upper position causes cable 130 to retain latch 200 in its upper position, in turn allowing hook portion 212 to move freely above catch 260.

When the operator wishes to close the door, he pushes it in direction 234. If for some reason the latch has sunken below its upper position, slanting latch strike surface 216 contacts cabinet strike surface 262, pushing the latch over the catch 260 and allowing the door to fully close.

The operator then screws the handle 110 in a direction (conventionally, clockwise) which causes threaded portion 118 to engage threaded receiving portion 116, securing the door in a closed position. At the same time, the operator's turning action of handle 110 causes bracket 120 to rotate downward, allowing the weight of latch 200 to cause it to settle atop catch 260. At this time, catch 260 is trapped beneath narrow portion 208, with cove 220 preventing the bottom of the door from being pulled outward in direction 236.

In this manner, latch 200 provides additional security to the interior 108 of the cabinet or vending machine, while not preventing the cabinet from being opened or closed by an authorized operator properly opening and closing the cabinet or vending machine with a key.

The described arrangement prevents vandals or thieves from prying open the door, in the following ways.

First, if the vandal or thief attempts to pry open the bottom of the door, he is effectively attempting to move the door outward, in direction 236. In this case, horizontal member 264 of catch 260 is trapped within cove 220, preventing further motion of door 100 even if the vending machine is shaken or jarred.

Conversely, if the thief or vandal attempts to pry open the top of the door, the control portion acts as an axis about which door 100 rotates, so that the bottom portion of the door attempts to move inward, in direction 234. In this case, the shoulder stop surface 254 on portion 206 of latch 200 contacts cabinet strike surface 262, preventing further motion of door 100 in direction 234.

Thus, in a simple arrangement of a remotely controlled latch, the present invention provides added security against vandalism and thievery, regardless of where the individual attempts to pry open the door.

Modifications and variations of the above-described embodiments of the present invention are possible, as appreciated by those skilled in the art in light of the above teachings. For example, the relative physical placement of the control portion and the latching portion may be changed, without varying the basic nature of the invention. Also, the particular shapes and composition of the components may be varied by those skilled in the art, without departing from the spirit and scope of the invention. Further, the invention need not be limited to embodiments in which there is a sole latch member for each control portion. It is therefore to be understood that, within the scope of the appended claims and their equivalents, the invention may be practiced otherwise than as specifically described.

What is claimed is:

1. An anti-theft mechanism for a door of an enclosure such as a vending machine, the mechanism comprising:

a) a latch, coupled to the door and for controllable engagement with a catch portion of the enclosure, the latch including surfaces forming a cove, the cove-forming surfaces oriented and positioned for surrounding the catch portion on at least part of all four sides of the catch portion, when the door is closed; and b) moveable means for moving the latch in first and second directions to allow the latch to surround the catch portion, or not to surround the catch portion, respectively.

2. The mechanism of claim 1, wherein the latch includes:

a hook portion which includes three surfaces at least partially surrounding the catch portion on three sides, one side of which is a lip structure which extends toward the door to partially surround the catch portion.

3. The mechanism of claim 2, wherein:

the lip structure is long enough to prevent the catch portion from escaping the cove when the door moves in the open direction without the movable means moving the latch in the second direction; and the lip structure is short enough to allow the catch portion to escape the cove when the movable means has moved the latch in the second direction and the door has not moved in the open direction.

4. The mechanism of claim 1, wherein the latch includes:

a substantially rectangular main body portion; and an extension extending from the main body to form a stop surface of the cove, the stop surface being arranged between the door and the catch portion, the stop surface contacting the catch portion when the portion of the door to which the latch is coupled moves inwardly into the interior of the enclosure, thereby substantially preventing motion of the door further inward than a position at which the stop surface contacts the catch portion.

5. The mechanism of claim 4, wherein:

the extension is a shoulder stop structure having a shoulder stop surface which extends substantially perpendicular to a main portion of the latch, the shoulder stop surface squarely engaging a corresponding surface of the catch portion so as to prevent further inward motion of the door.

6. The mechanism of claim 1, further comprising:

a control portion, the control portion including a clutch mechanism, the control portion positioned for manipulation by an operator, the control portion loosely coupled to the moveable means by the clutch mechanism for allowing the movable means to move with the control portion unless the movable means encounters a barrier or is otherwise restrained from movement.

7. The mechanism of claim 6, wherein the control portion includes:

a handle; and a stud, coupled to the handle for rotation therewith.

8. The mechanism of claim 7, further comprising:

a receiving portion, attached to a cabinet portion of the enclosure and matingly engageable with the stud, for securing the door to the cabinet portion.

9. The mechanism of claim 7, wherein:

the stud includes an extension projecting outwardly; and the clutch mechanism includes a pressing means for pressing the movable means against the outward extension with a force sufficient to cause the movable means to move with the stud unless the movable means encounters a barrier or is otherwise restrained from movement.

10. The mechanism of claim 9, wherein:

the extension is a disk-shaped extension; and the pressing means comprises a coil spring arranged substantially concentrically with the stud, the coil spring pressing the movable means against the disk-shaped extension.

11. The mechanism of claim 7, wherein:

the movable means is a bracket member with an aperture through which the stud passes, the bracket member rotatable about the stud.

12. The mechanism of claim 11, further comprising:

a stop member, disposed at a point at which the bracket member may intersect it in rotating about the stud, the stop member positioned so as to allow the bracket member to move so that the latch may substantially surround the catch portion when the bracket member contacts it.

13. The mechanism of claim 6, further comprising:

a stop member, disposed at a point at which the movable means may intersect it in rotating with the control portion, the stop member positioned so as to allow the movable means to move so that the latch may substantially surround the catch portion when the movable means contacts it.

14. An anti-theft mechanism for a door of an enclosure such as a vending machine, the mechanism comprising:

a) a latch, coupled to the door and for controllable engagement with a catch portion of the enclosure, the latch including:

i) surfaces forming a cove, the cove-forming surfaces oriented and positioned for at least partially surrounding the catch portion when the door is closed, one of the surfaces comprising a shoulder stop surface, the shoulder stop surface disposed between (1) the portion of the door to which the latch is coupled and (2) the catch portion, the shoulder stop surface preventing motion of the door further inward than a position at which the stop surface contacts the catch portion; and b) moveable means for moving the latch in first and second directions to allow the latch to at least partially surround the catch portion, or not to partially surround the catch portion, respectively.

15. An anti-theft mechanism for a door of an enclosure such as a vending machine, the mechanism comprising:

a) a latch, coupled to the door and for controllable engagement with a catch portion of the enclosure, the latch including surfaces forming a cove, the cove-forming surfaces oriented and positioned for at least partially surrounding the catch portion when the door is closed, one of the surfaces comprising a lip structure which extends toward the door to partially surround the catch portion; and b) a moveable member which controls the position of the latch, for moving the latch first and second directions to allow the latch to at least partially surround the catch portion, or not to partially surround the catch portion, respectively;

wherein:

1) the lip structure is long enough to prevent the catch portion from escaping the cove when the door moves in the open direction without the movable member moving the latch in the second direction; and 2) the lip structure is short enough to allow the catch portion to escape the cove when the movable member has moved the latch in the second direction when the door has not moved in the open direction.

16. An anti-theft mechanism for a door of an enclosure such as a vending machine, the mechanism comprising:

a) a latch, affixed to the door and shaped for controllable engagement with a catch portion of the enclosure;

b) a moveable member which controls the position of the latch, the movable member loosely coupled to a control portion, the movable member for:

1) moving the latch to a first position avoiding the catch portion and allowing the door to be opened or closed; and 2) allowing the latch to move a second position in which the latch engages the catch portion so as to prevent the door from opening; and c) the control portion, which includes:

1) an arrangement for securing or unsecuring the door to a cabinet of the enclosure; and 2) an arrangement for maintaining the moveable member in a first extreme position corresponding to the first position of the latch, regardless of continued motion of the control portion in unsecuring the door.

17. A mechanism for securing a door of a vending machine, the mechanism comprising:

a) a handle for securing and unsecuring the door of the vending machine;

b) a stud, coupled to and adapted to rotate with the handle, the stud including a stud extension;

c) a bracket, loosely fitted about the stud and capable of rotating about the stud;

d) a spring member, arranged to compress the bracket into contact with the stud extension, so that the bracket rotates with the stud unless the bracket encounters a barrier or is otherwise restrained from movement;

e) a bracket stop member, disposed at a point where the bracket will contact it;

f) a catch, affixed to the vending machine;

g) a latch, rotatably affixed to the door, the latch forming a cove, the cove at least partially encompassing the catch on all four sides of the catch when the door is closed, the cove defined by:

1) a latch main body;

2) an end segment, extending from an end of the latch main body;

3) a lip, extending from an end of the end segment; and 4) a shoulder stop;

h) a cable, extending between the bracket and the latch; and i) a limit member, attached to the door at a point to prevent motion of the latch in a first latch direction corresponding to motion of the bracket when the handle is moved in a direction causing unsecuring of the door;

wherein when the handle causes motion of the stud in a first stud direction corresponding to unsecuring of the door, the bracket moves in a first bracket direction until the latch encounters the limit member, at which time the cable stops the bracket's rotational motion with the stud; and wherein when the handle causes motion of the stud in a second stud direction corresponding to securing the door, the bracket rotates in a second bracket direction corresponding to the securing of the door, the latch moves in a second latch direction away from the limit structure to engage the catch so as to secure the door to the vending machine, and the bracket encounters the bracket stop but the stud continues to rotate without further motion of the bracket.

* * * * *